United States Patent [19]

Walker et al.

[11] 4,419,649

[45] Dec. 6, 1983

[54] CIRCUIT BREAKER FOR USE ON AC AND DC CIRCUITS

[75] Inventors: Eugene J. Walker; James P. Ellsworth, both of Beaver, Pa.

[73] Assignee: Westinghouse Electric Corp., Pittsburgh, Pa.

[21] Appl. No.: 318,226

[22] Filed: Nov. 4, 1981

[51] Int. Cl.[3] ..... H01H 71/16

[52] U.S. Cl. ..... 337/70; 335/43; 337/77

[58] Field of Search ..... 337/70, 71, 72, 77; 335/43, 35

[56] References Cited

U.S. PATENT DOCUMENTS 2,939,929 6/1960 Hobson, Jr. ..... 335/43

3,296,564 1/1967 Cellerni ..... 335/35

*Primary Examiner*—Harold Broome

*Attorney, Agent, or Firm*—Robert E. Converse, Jr.

[57] ABSTRACT

A circuit breaker suitable for use on both AC and DC circuits includes a magnetically permeable core surrounding a current carrying conductor of the circuit breaker. A bimetal member is thermally coupled to the core such that induction heating of the core due to overload AC current flowing through the conductor is operative to deflect the bimetal and actuate a trip device. The circuit breaker also includes a pair of braided copper shunts connected between the conductor and the bimetal such that resistive heating of the conductor due to overload DC current flow through the breaker will cause the bimetal to deflect and actuate a trip device. The bimetal is mechanically isolated from the conductor such that relative movement therebetween will not affect thermal calibration of the circuit breaker.

14 Claims, 5 Drawing Figures

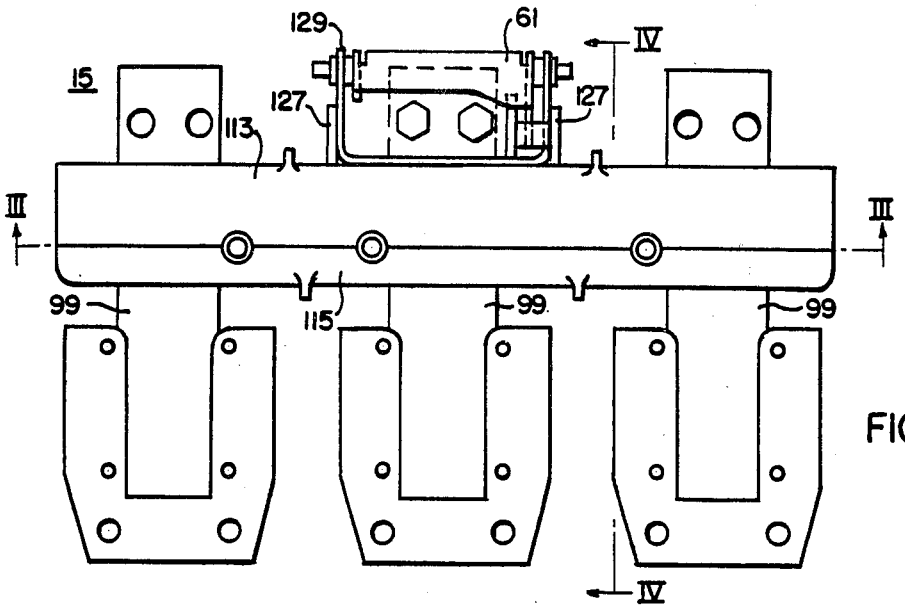
FIG.2.
FIG.3.
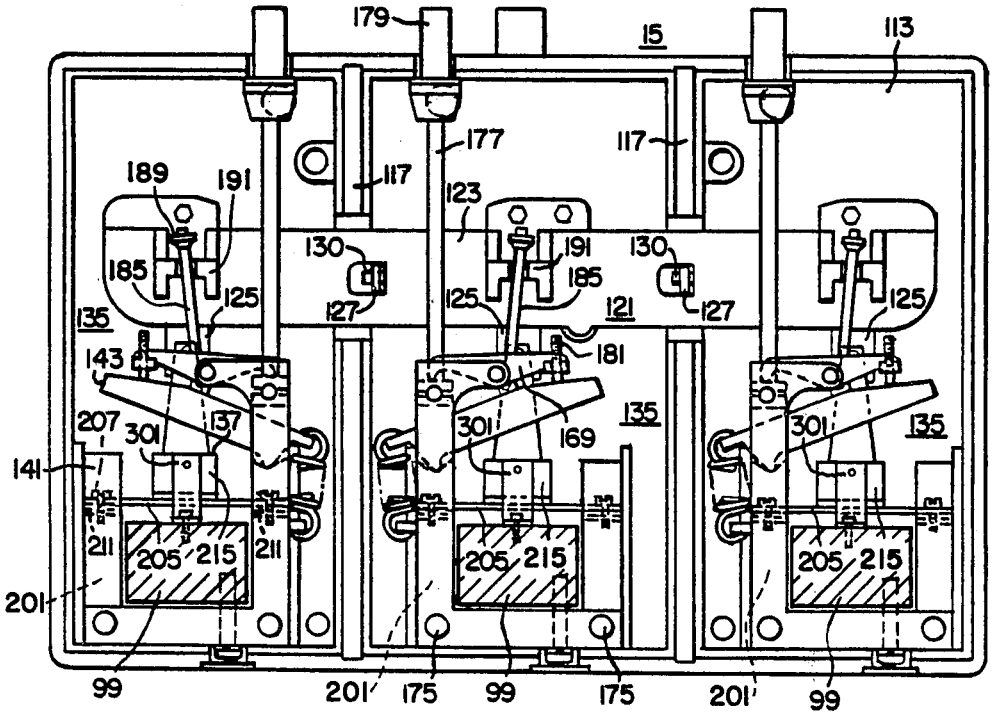

CIRCUIT BREAKER FOR USE ON AC AND DC CIRCUITS

BACKGROUND OF THE INVENTION

The invention relates generally to circuit breakers and, more particularly, to circuit breakers employing thermal trip means.

For certain applications, Underwriter's Laboratories has established requirements calling for a circuit breaker to carry 110% of rated current continuously at an ambient temperature of 25° C. without tripping. Additional requirements call for the circuit breaker to trip within two hours at 135% of rated current and within a specified shorter time at 200% rated current depending on the breaker rating. For example, a breaker with a rating of 800 amperes must trip within 14 minutes at a test current of 16000 amperes. A circuit breaker which meets these requirements when applied to alternating current circuits is described in U.S. Pat. No. 3,296,564 issued Jan. 3, 1967 to Albert R. Cellerini and assigned to the assignee of the present invention. The circuit breaker described therein utilizes an induction heating type of thermal trip mechanism to establish the desired time-current trip characteristic.

There is increasing demand for DC breakers operating at higher ratings for applications such as uninterruptible power supplies for computer systems. In lower rating circuit breakers the bimetal portion of the thermal trip unit was often connected in series with the main contacts of the circuit breaker. However, this is not practical in higher rating breakers due to the magnitude of currents involved. Accordingly, higher rating breakers have employed induction apparatus such as disclosed in the aforementioned U.S. Pat. No. 3,296,564 to reduce the amount of current flow and heat losses in the bimetal element. However, such apparatus has heretofore precluded the use of such breakers on DC circuits.

It would be desirable to provide a circuit breaker having an induction heating thermal trip mechanism which meets Underwriter's Laboratories requirements when applied to either AC or DC circuits.

SUMMARY OF THE INVENTION

In accordance with the principles of the present invention, there is provided a circuit breaker adapted for use on AC and DC circuits which includes separable contacts, an interrupter mechanism operating the contacts between open and closed positions, a conductor connected in series with the contacts and adapted for connection to an external circuit, and a trip device operable when actuated to cause the interrupter mechanism to automatically open the contacts. The trip device includes an induction-operated thermal trip assembly having a magnetically permeable core surrounding the conductor for generating heat as a result of current induced therein by AC current flow through the conductor. The thermal trip assembly also includes a bimetal member thermally coupled to the magnetically permeable core and so positioned with respect to the trip device that deflection of the bimetal due to heat generated as a result of AC current flow above a first predetermined level is operable to actuate the trip device and cause the interrupter mechanism to open the contacts. The circuit breaker also includes means for thermally coupling the bimetal to the conductor so that heat generated in the conductor by flow of DC current therethrough is transmitted through the coupling means to the bimetal such that DC current flow through the conductor above a second predetermined level is operable to generate heat which deflects the bimetal to actuate the trip device and cause the interrupter means to open the contacts.

BRIEF DESCRIPTION OF THE DRAWINGS

The invention may be best understood from the following detailed description when read in conjunction with the accompanying drawings.

FIG. 2 is a top elevational view of the removable three-pole trip device shown in FIG. 1;

FIG. 3 is a sectional view taken generally along the line III—III of FIG. 2;

DESCRIPTION OF THE PREFERRED EMBODIMENT

Figure 1:
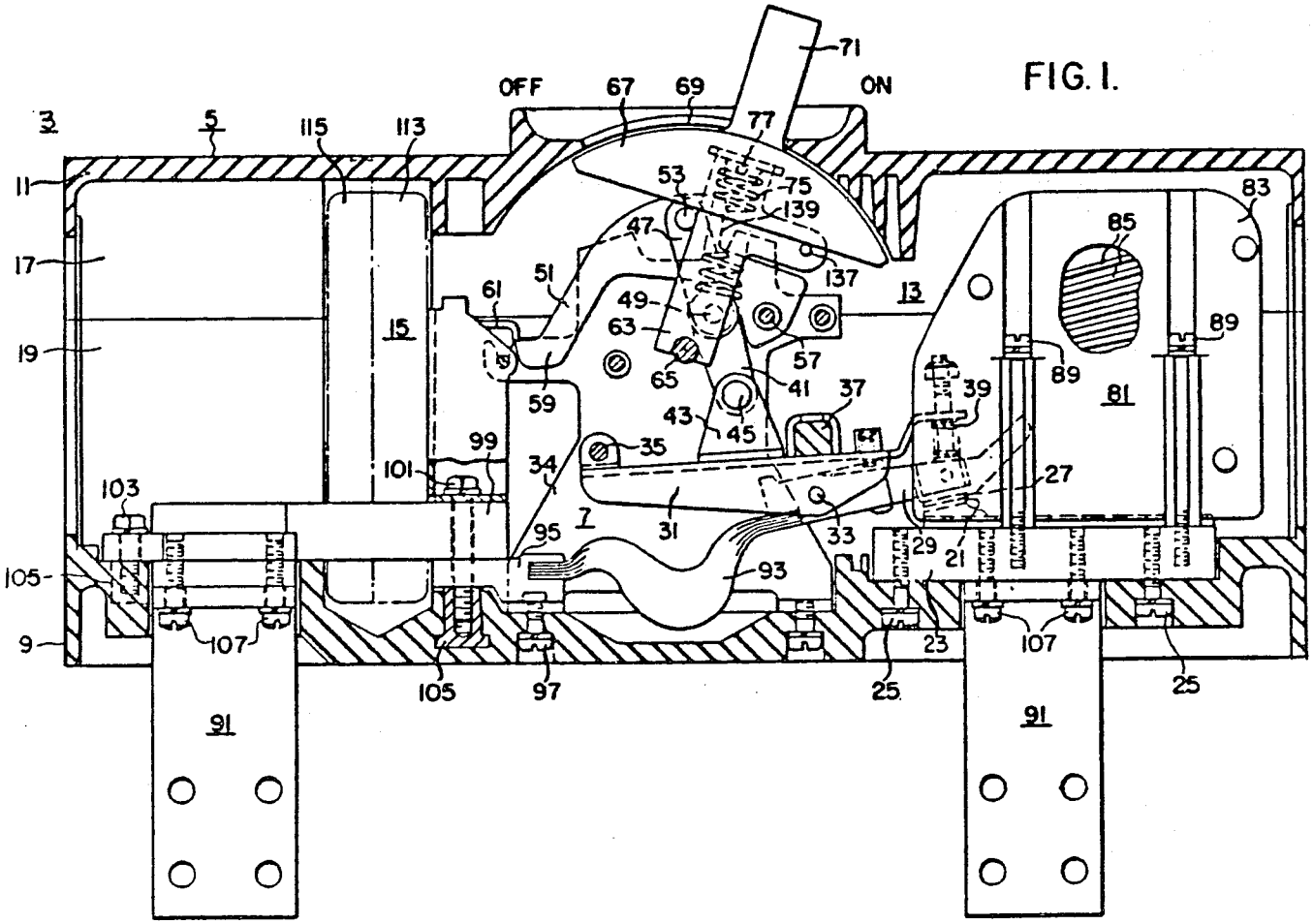
FIG. 1 is a side sectional view showing the internal compartment of a three-pole circuit breaker incorporating the principles of the present invention, with certain parts broken away, and with certain parts shown in elevation.

Referring to the drawings, there is shown in FIG. 1 a circuit breaker 3 comprising an insulating housing 5 and a circuit-breaker mechanism 7 supported within the housing. The housing 5 comprises a base 9 and a cooperating cover 11 both of molded insulating material. The circuit breaker is of the type known in the art as a molded-case or insulating-housing type circuit breaker. The circuit breaker is of the type specifically described in the aforementioned U.S. Pat. No. 3,296,564.

The circuit-breaker mechanism 7 comprises an operating mechanism 13 and a trip device or trip unit 15. The circuit breaker 3 is a three-pole circuit breaker comprising three compartments disposed in a side-by-side relationship within the insulating housing 5. The center compartment or pole unit is separated from each of the two outer pole units by a separate insulating barrier 17, 19 molded integral with the cover 11 and base 9, respectively. The operating mechanism 13 is a single operating mechanism disposed in the center pole unit for simultaneously operating the contacts of all three of the pole units.

Each pole unit comprises a stationary contact 21 that is fixedly secured to a rigid main conductor 23 that is secured to the base 9 by means of bolts 25. In each pole unit a movable contact 27 is welded or brazed to a contact arm 29 that is pivotally mounted on a switch arm 31 by means of a pivot pin 33. Each of the switch arms 31 is pivotally supported at one end thereof on a separate support bracket 34 by means of a separate pivot pin 35. The switch arms 31 for all three of the pole units are connected to move in unison by means of a common tie bar 37 that is rigidly connected to all three of the switch arms. Each of the contact arms 29 is biased about the associated pivot 33 by means of a spring 39 to provide contact pressure in the closed position.

The switch arms 31 are operated to the open and closed positions by means of the operating mechanism 13. The operating mechanism 13 comprises a toggle link 41 that is pivotally connected to an extension 43 of the centerpole switch arm 31 by means of a pivot pin 45. The toggle link 41 is pivotally connected to another toggle link 47 by means of a knee pivot pin 49. The upper end of the toggle link 47 is pivotally connected to a cradle or releasable member 51 by means of a pivot pin 53. The member 51 is pivotally supported at one end thereof on the supporting bracket 34 by means of a pivot pin 57. The other end 59 of the releasable member 51 is held in a latched position by means of a latch member 61. The operating mechanism 13 also comprises a generally U-shaped operating lever 63 that is pivotally supported on the bracket 34 by means of pivot pins 65 that engage the inner ends of the legs of the operating lever 63. An insulating shield 67, for substantially closing an opening 69 in the cover 11, is secured to the upper end of the operating lever 63. The shield 67 has an integral insulating handle portion 71 extending out through the opening 69 to permit manual operation of the breaker. Two overcenter springs 75 (only one being shown in FIG. 1) are connected under tension between the knee pin 49 of the toggle 41, 47 and the upper end of the operating lever 63. Pin means 77 are secured to the upper end of the lever 63 in order to support the upper ends of the springs 75.

In each pole unit, an arc-extinguishing unit 81 is provided to extinguish the arc drawn between the associated contacts 21, 27. Each arc-extinguishing unit 81 comprises an insulating housing 83 and a plurality of magnetic steel plates 85 supported within the housing 83. The movable contact 27 moves within a generally V-shaped opening in the stacked plates 85, and the arc drawn between the contacts 21, 27 is magnetically moved to the right (FIG. 1) into the plates 85 to be extinguished. Each of the arc-extinguishing units 81 is secured to the manin conductor 23 by means of four bolts 89 that are threaded into tapped openings in the conductor 23.

For each pole unit, the circuit breaker 3 is provided with two rear-type terminal connectors 91 suitably secured at opposite ends at the back or bottom of the circuit breaker.

Referring to FIG. 1, the circuit through each pole unit of the circuit breaker 3 extends from the right-hand terminal 91 through the conductor 23, the contacts 21, 27, the contact arm 29, flexible conductors 93 that are secured to the contact arm 29 and also to a terminal member 95, the terminal member 95 that is secured to the base 9 by means of a screw 97, a unitary rigid main conductor 99 that is connected to a terminal conductor 95 and that is secured to the base 9 by means of bolts 101 and 103, to the other rear-type terminal connector 91. The bolts 101 and 103 are threaded into tapped inserts 105 in the base 9 to secure the main conductor 99 and removable trip unit 15 to the base unit 9. Each of the rear-type terminal connectors 91 is connected to the associated internal conductor (23 or 99) by means of four bolts 107.

The circuit breaker 3 is manually operated to the open position by movement of the handle 71 in a counterclockwise (FIG. 1) direction to the "off" position. During this movement, the line of action of the overcenter spring means 75 is moved to the left to an overcenter position to effect a collapse of the toggle 41, 47 to pivot the switch arm 31 for the center pole in a counterclockwise direction about the associated pivot 35 to an open position. This movement, because of the connection of all of the switch arms 31 by means of the common tie bar 37, simultaneously moves all of the three switch arms 31 to the open position.

The circuit breaker is manually closed by reverse movement of the handle 71 from the "off" to the "on" position. This movement moves the operating lever 63 to move the line of action of the overcenter spring means 75 to the right to thereby reset the toggle 41, 47 moving all three of the switch arms 31 simultaneously to the closed position.

Referring to FIGS. 1–4, the trip device 15 comprises a molded insulating base 113 and a molded insulating cover 115 cooperable with the base to enclose three thermal and magnetic trip means which are disposed within three compartments in the trip unit housing 113, 115. The compartments are separated by means of cooperating insulating barriers 117, 119 (FIGS. 3 and 4) molded integral with the insulating base 113 and cover 115, respectively. The trip device 15 includes a trip structure 121 (FIG. 3) comprising a molded insulating trip bar 123 and three stabilizing bimetal members 125 that are fixedly secured to the trip bar 123, each of the stabilizing bimetal members 125 being disposed in a different one of the three pole unit compartments. The trip bar 123, which passes through suitable openings in the trip-unit housing barriers 117, 119, is common to all three of the pole units. The trip bar 123 is pivotally supported on two spaced bracket arms 127 (FIG. 4) that extend out of the base 113. The bracket arms 127 are supported on a suitable supporting bracket 129. Pivot pins 130 pivotally support the trip bar 123 on the bracket arms 127. In addition to the common trip structure 121, the trip unit 15 comprises three thermal and magnetic trip means 135 (one for each pole unit) which are disposed generally below (FIGS. 3 and 4) the trip structure 121.

Figure 4:
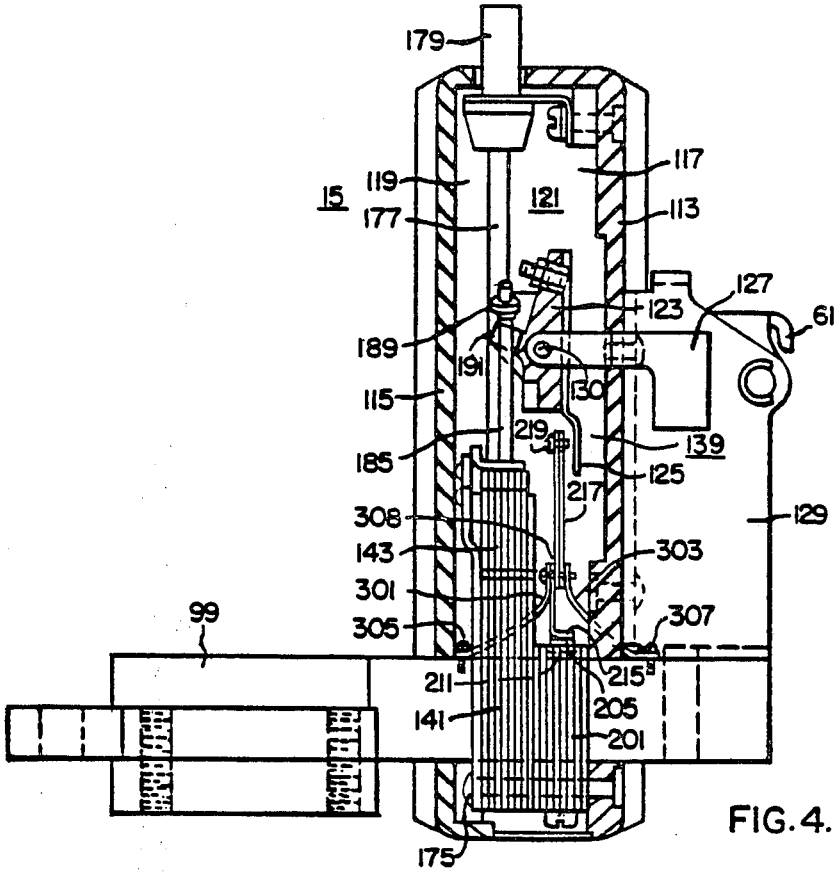
FIG. 4 is a sectional view taken generally along the line IV—IV of FIG. 2.

Each of the thermal and magnetic trip means 135 comprises an electromagnetic trip means and a thermal trip means 139 (FIGS. 3 and 4). The electromagnetic trip means, comprising a generally U-shaped part 141 of magnetically permeable material such as soft iron and a clapper-type armature 143 which is also of a magnetically permeable material such as soft iron, forms no part of the present invention and is described more completely in the aforementioned U.S. Pat. No. 3,296,564.

The circuit breaker is tripped open instantaneously upon the occurrence of a severe overload, of for example ten times the normal rated current, through any of the three pole units of the circuit breaker. Upon the occurrence of the severe overload or short circuit through one of the conductors 99, the magnetic flux generated in the associated electromagnetic trip 141, 143 is strong enough to attract the armature 143 toward the member 141, and the armature 143 is pivoted into engagement therewith. As the armature 143 moves into engagement with the member 141, a rod 185, which is pivotally supported to the armature 143, is pulled down whereupon a head portion 189 (FIGS. 3 and 4) on the rod 185 engages a part 191 of the insulating trip bar 123 to pivot the trip bar 123 causing the trip bar to rotate in a counterclockwise (FIG. 4) direction about the pivot pins 130. This movement effects a releasing movement of the latch 61 to disengage the latch 61 from the cradle 51 (FIG. 1). Upon release of the cradle 51, the springs 75 act to rotate the cradle in a clockwise direction about the pivot 57 and to collapse the toggle 41, 47 to thereby pivotally move the three switch arms 31 in a counterclockwise direction to open position. During the automatic tripping operation the spring means 75 operates to move the operating lever 63 and handle 71 to an intermediate position between the "on" and "off" positions in a well-known manner to thereby provide a visual indication that the circuit breaker has been automatically tripped.

Following an automatic tripping operation, it is necessary to reset and relatch the circuit-breaker mechanism before the contacts can be closed. This is accomplished by moving the handle 71 to the full "off" position. During this movement, a pin 137 that is supported on the operating lever 63 engages a shoulder 139 on the cradle 51 moving the cradle in a counterclockwise direction about the pivot 57. Near the end of this movement, the free or latching end 59 of the cradle 51 cams the latch 61 to the left against the bias of spring means (not shown) and moves below the latching end of the latch 61 whereupon the latch is biased back to the latching position seen in FIG. 1 to relatch the cradle 51 in a wellknown manner. The breaker contacts can then be closed in the previously described manner by movement of the handle 71 to the "on" position. The electromagnetic tripping operation occurs instantaneously without a time delay upon the occurrence of a predetermined severe overload such, for example, as ten times or more of the normal rated current.

Referring to FIGS. 3 and 4, the thermal trip 139 comprises a generally U-shaped part 201 of magnetically permeable material such as soft iron. The generally U-shaped part 201 comprises a plurality of laminations. The U-shaped part 201 is supported on the trip unit insulating base 113 (FIG. 4) by means of the same rivets 175 that secure the part 141 of the magnetic trip to the base 113. A magnetically permeable solid steel bimetal support 205 is supported on the U-shaped part 201 and secured thereto by means of two screws 207 that pass through suitable openings in the support 205. The screws 207 are threaded into tapped openings in the free ends of the legs of the member 201. Nonmagnetic shims 211 are removably disposed (two at each side) between the members 205 and 201. With the provision of the shims 211 an adjustable gap is provided to permit adjustment of the thermal trip 139. A tripping bimetal member 217 is fixedly secured through a mounting bracket 215 to the support 205 in a heat-conducting relationship. An adjusting screw 219 is threaded into a tapped opening in the upper end of the vertical leg of the bimetal 217.

Referring to FIG. 3, it will be seen that the laminated U-shaped part 201 and the solid bimetal support bar 205 cooperate to form a one-turn magnetic circuit around the energizing conductor 99. An energizing alternating current through the conductor 99 generates magnetic flux in the magnetic circuit 201, 205 to induce eddy currents in the bimetal support 205 that serve to heat the bimetal support. Hysteresis losses account for additional heating of the bimetal support 205 when the conductor 99 is energized. The eddy current and hysteresis losses are core losses that occur in the form of heat in the bimetal support 205. This heat is conducted to the bimetal 217 through the bracket 215 that is supported on the bar 205 in a heat-conducting relationship.

As can be seen in FIGS. 3 and 4, a pair of flexible braided metallic heat-conductive shunts 301 and 303 are secured to the conductor 99 by screws 305 and 307, respectively. The other ends of the shunts 301 and 303 are securely attached as by brazing or riveting to the bimetal 217. The shunts 301 and 303, which may be constructed of braided copper strands, act as conduits to conduct heat produced in the conductor 99 by current flow therethrough to the bimetal 217. Since this heating effect of the bimetal 217 is produced independently of any induction effect by the magnetic circuits 201, 205, DC current flow through the conductor 99 will be operative to cause the bimetal to deflect and trip the breaker according to the desired time-current trip characteristic.

Note that bimetal 217 is not rigidly connected to the conductor 99. This is important, since minor movements of the conductor 99 relative to the thermal trip means 139 will not result in loss of calibration.

When there is no current running through the circuit breaker 3, the tripping bimetal 217 and stabilizing bimetal 125 are in the positions seen in FIG. 4. The high expansion side of the tripping bimetal 217 is on the left as viewed in FIG. 4 and the high expansion side of the stabilizing bimetal 125 is also on the left as viewed in FIG. 4. When the circuit breaker is in operation and when the circuit is carrying 100% of the rated current, the tripping bimetal 217 is heated through the action of the thermal trip 139 in the same manner as was hereinbefore described. The tripping bimetal is also heated by a rise in the ambient temperature within the insulating housing 5 of the circuit breaker. Thus, there is an initial deflection to the right (FIG. 4) of the tripping bimetal 217. It is important that this initial deflection of the tripping bimetal 217 does not trip the circuit breaker since the circuit breaker is rated to carry 110% of the rated current without tripping. Thus, the stabilizing bimetal member 125 is provided. When the citrcuit breaker is energized to carry 110% of the rated current the stabilzing bimetal 125 deflects to the right (FIG. 4) upon the occurrence of a rise in the ambient temperature within the circuit breaker housing 5 to prevent a tripping operation. When a tripping overload current such as, for example, a current of 135% of the rated current passes through the conductor 99, the tripping bimetal 217 will be heated to deflect sufficiently to engage the stabilizing bimetal 125 to rotate the trip bar structure 121 to a tripping position to effect a tripping operation of the circuit breaker in the same manner as was hereinbefore described. The circuit breaker thermal trip means 139 is constructed such that the circuit breaker will be tripped within two hours when 135% of the rated current is passed through the conductor 99 and within 14 minutes when 200% of the rated current is passed through the energizing conductor 99 of an 800 ampere breaker. The armature 143 remains in the unattracted position until a severe overload such as, for example, 10 or more times the rated current of the circuit breaker passes through the energizing conductor 99, whereupon the armature 143 will be instantly attracted to the closed position to effect a tripping operation in the same manner as was hereinbefore described.

Figure 5:
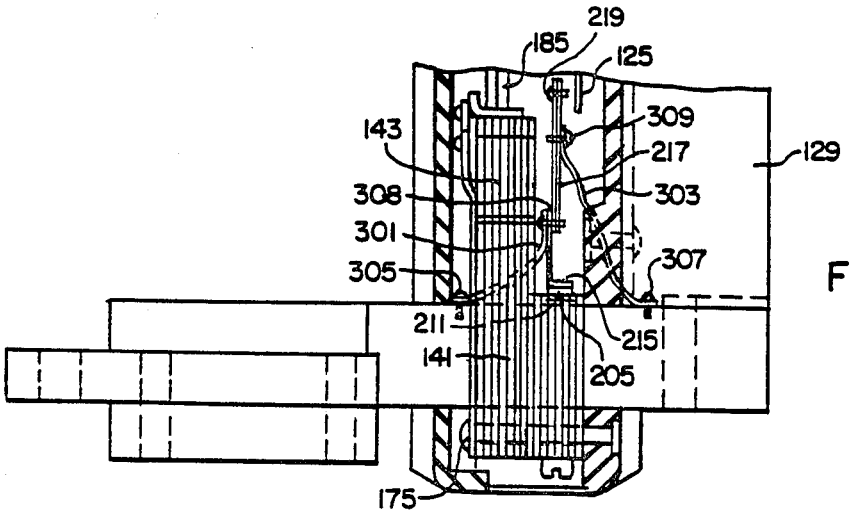
FIG. 5 is a view similar to FIG. 4, showing an alternative embodiment of the present invention.

An alternative embodiment is shown in FIG. 5 wherein the shunts 301 and 305 are attached to the bimetal 217 at different points, namely 308 and 309. Such construction allows heat from the conductor 99 to be supplied to both ends of the bimetal 217, thereby giving greater deflection for a given flow of current through the conductor 99 than the construction shown in FIGS. 3 and 4.

Although there is a finite voltage drop between the points 305 and 307 on the conductor 99, the relative sizes of the shunts 301, 303 and the conductor 99 are such that the current flow through the shunts is extremely small. The effect of resistance heating of the bimetal 217 is therefore negligible compared to that of conducted heat.

It can be seen that the present invention provides a circuit breaker having an induction type thermal trip unit which is applicable to both alternating and direct current circuits.

I claim:

1. A circuit breaker adapted for use on AC and DC circuits, comprising:

separable contacts;

an interrupter mechanism for operating said contacts between open and closed positions;

a trip device operable when actuated to cause said interrupter mechanism to automatically open said contacts;

a conductor connected in series with said contacts; and an induction operated thermal trip assembly comprising means inductively coupled to said conductor for generating heat as a result of current induced therein by AC current flow through said conductor, said thermal trip assembly also comprising a bimetal member thermally coupled to said heat generating means and so positioned with respect to said trip device that deflection of said bimetal member due to heat generated as a result of AC current flow above a first predetermined level is operable to actuate said trip device and cause said interrupter mechanism to open said contacts;

said thermal trip assembly also comprising thermal conduction means for thermally coupling said bimetal member to said conductor such that heat generated in said conductor by the flow of DC current therein is transmitted by conduction through said thermal conduction means to said bimetal member;

whereby DC current flow through said conductor above a second predetermined level is operable to generate heat deflecting said bimetal member to actuate said trip device and cause said interrupter means to open said contacts.

2. A circuit breaker as recited in claim 1 wherein said thermal conduction means comprises resilient thermal coupling means for conducting heat from said conductor to said bimetal member while maintaining thermal calibration of said circuit breaker in the face of relative movement between said conductor and said thermal trip assembly.

3. A circuit breaker as recited in claim 2 wherein said resilient thermal coupling means comprises a braided metallic shunt.

4. A circuit breaker as recited in claim 2 wherein said resilient thermal coupling means comprises a pair of braided metallic shunts.

5. A circuit breaker as recited in claim 4 wherein said shunts comprise braided copper strands.

6. A circuit breaker as recited in claim 4 wherein said shunts are connected to said bimetal member at two spaced-apart connection points.

7. A circuit breaker as recited in claim 6 wherein said bimetal member comprises an elongated bimetal member mechanically secured at one end to said conductor, the other end of said elongated bimetal member being free to deflect in response to heating of said bimetal member, one of said shunt connection points being located closer to said fixed bimetal member end than the other of said shunt connection points.

8. A circuit breaker as recited in claim 4 wherein one end of each of said shunts is mechanically secured to said bimetal member and the other ends of each of said shunts are mechanically secured to said conductor on opposite sides of said heat generating means.

9. A circuit breaker as recited in claim 8 wherein said shunts are mechanically secured to said bimetal at two different connecting points.

10. A circuit breaker as recited in claim 9 wherein said bimetal member comprises an elongated bimetal member mechanically secured at one end to said heat generating means, the other end of said elongated bimetal member being free to deflect in response to heating of said bimetal member, one of said shunt connection points being located in greater proximity to said fixed bimetal members end than the other of said shunt connection points.

11. A DC circuit breaker, comprising, separable contacts;

an interrupter mechanism for operating said contacts between open and closed positions;

a trip device operable when actuated to cause said interrupter mechanism to automatically open said contacts;

a conductor connected in series with said contact; and thermal trip means comprising a bimetal member and resilient thermally conductive means connected to said conductor and to said bimetal member for conducting heat therebetween such that heating of said conductor due to overcurrent conditions through said circuit breaker is operative to cause deflection of said bimetal member, said bimetal member being so positioned with respect to said trip device that deflection of said bimetal member causes actuation of said trip device to effect automatic separation of said contacts, said bimetal member being mechanically isolated from said conductor such that movement of said conductor relative to said thermal trip means does not effect calibration of said thermal trip means.

12. A circuit breaker as recited in claim 11 wherein said resilient thermally conductive means comprises a braided metallic shunt.

13. A circuit breaker as recited in claim 11 wherein said resilient thermally conductive means comprises a pair of braided metallic shunts.

14. A circuit breaker as recited in claim 13 wherein said bimetal member comprises a first end fixedly attached to said thermal trip means and a second end free to deflect in respons to heat conducted from said conductor means, said pair of braided metallic shunts being connected to said bimetal member at spaced-apart points.

* * * * *